US008398780B2

(12) United States Patent
Krauss et al.

(10) Patent No.: US 8,398,780 B2
(45) Date of Patent: Mar. 19, 2013

(54) METHOD FOR THE PRETREATMENT OF POLYMER SURFACES TO BE PAINTED

(75) Inventors: Peter Krauss, Münchberg (DE); Jörg Braun, Heubach (DE); Olaf Eckardt, Crailsheim (DE)

(73) Assignee: Rehau AG + Co, Rehau (DE)

( * ) Notice: Subject to any disclaimer, the term of this patent is extended or adjusted under 35 U.S.C. 154(b) by 393 days.

(21) Appl. No.: 12/663,865

(22) PCT Filed: Jun. 10, 2008

(86) PCT No.: PCT/EP2008/004620

§ 371 (c)(1),
(2), (4) Date: May 21, 2010

(87) PCT Pub. No.: WO2008/151772

PCT Pub. Date: Dec. 18, 2008

(65) Prior Publication Data

US 2010/0288310 A1 Nov. 18, 2010

(30) Foreign Application Priority Data

Jun. 12, 2007 (DE) ..... 10 2007 027 618

(51) Int. Cl.
*B08B 7/00* (2006.01)

(52) U.S. Cl. ..... 134/19; 134/26

(58) Field of Classification Search ..... None
See application file for complete search history.

(56) References Cited

U.S. PATENT DOCUMENTS

| | | | | |
|---|---|---|---|---|
| 5,569,685 | A | 10/1996 | Schreiber et al. | |
| 6,083,336 | A | 7/2000 | Kiriazis | |
| 6,447,377 | B1 * | 9/2002 | Londenberg et al. | 451/90 |
| 2005/0100674 | A1 | 5/2005 | Brown et al. | |
| 2006/0121284 | A1 * | 6/2006 | Held et al. | 428/411.1 |
| 2006/0193982 | A1 | 8/2006 | Zafera et al. | |

FOREIGN PATENT DOCUMENTS

| | | |
|---|---|---|
| DE | 4407121 | 5/1995 |
| DE | 19529583 | 2/1997 |
| DE | 602004001309 | 4/2005 |

OTHER PUBLICATIONS

International Search Report.

* cited by examiner

*Primary Examiner* — Eric Golightly
(74) *Attorney, Agent, or Firm* — Da Vinci Partners LLC

(57) ABSTRACT

A method and device for the pretreatment of polymer surfaces of components to be painted. At least one polymer surface of at least one component is preheated to a temperature that minimizes condensation on the component when the component is subsequently cleaned inside a pretreatment cell and then treated with an oxidizing flame. The cleaning of the polymer surface as well as the treatment of the polymer surface with an oxidizing flame are performed inside the same pretreatment cell.

7 Claims, 2 Drawing Sheets

METHOD FOR THE PRETREATMENT OF POLYMER SURFACES TO BE PAINTED

CROSS REFERENCE TO RELATED APPLICATIONS

This application is the National Stage of International Application No. PCT/EP2008/004620, filed Jun. 10, 2008, which claims benefit under 35 USC §119(a), to German patent application Ser. No, 10 2007 027 618.6, filed Jun. 12, 2007.

BACKGROUND OF THE INVENTION

The invention relates to a method for the pretreatment of polymer surfaces of components to be painted in which at least one polymer surface of at least one component is cleaned inside a pretreatment cell and subsequently treated with an oxidizing flame.

Components made of polymer substances, for example, plastic bumpers for the automotive industry, are commonly painted in a three-step painting process; as a rule, an undercoat or primer is applied, then a colored base coat is applied, and finally a clear lacquer surface is applied. Omitting the undercoat primer and applying the base coat directly to the plastic substrate is also known. An additional known solution involves single-coat painting or dual-coat painting using solvents or water-based paints As a rule, before painting the surfaces of such components, the components are pretreated, with a typical pretreatment including cleaning the surface of the component and, after cleaning the surface, a treatment of the surface with an oxidizing flame, in particular for improving the adhesive properties. Here, the surface cleaning is conducted by means of an aqueous, multi-zone washing system or using carbon dioxide snow ($CO_2$ snow) or carbon dioxide pellets ($CO_2$ pellets). The two process steps, i.e., cleaning and flame treatment, occur in cells or parts of the system that are separate, enclosed, and separately ventilated.

This known distribution of the two process steps into two such separate cells requires a large amount of space, which is associated with a high energy use. Moreover, this known division of the two process steps is associated with long throughput times. Finally, after the surface has been cleaned, the component must be transferred out of the cell in which it was cleaned and into the cell provided for flame treatment. In spite of all preventative measures, undesired impurities often occur during transfer of the already-cleaned component surface due to outside influences, which ultimately have a detrimental effect on the quality of the paint job.

Therefore, overall, the currently known methods for the pretreatment of polymer surfaces to be painted are very cost-intensive and laborious. Moreover, these methods are quite susceptible to contaminations that are detrimental to quality.

What is needed therefore is a method for the pretreatment of polymer surfaces of components to be painted by means of which a cost-effective and practical pretreatment of polymer surfaces to be painted is possible as compared to known solutions, and by means of which the quality of the paint job may be improved.

SUMMARY OF THE INVENTION

A method and device for the pretreatment of polymer surfaces of components to be painted. At least one polymer surface of at least one component is preheated to a temperature that minimizes condensation on the component when the component is subsequently cleaned inside a pretreatment cell and then treated with an oxidizing flame.

The object of the invention is attained by the method for the pretreatment of polymer surfaces of foregoing components to be painted, in which the cleaning of the polymer surface as well as the treatment of the polymer surface with an oxidizing flame are both performed inside the same pretreatment cell.

According to the invention, the pretreatment cell is preferably designed in an enclosed fashion and is tempered and/or climate controlled. The pretreatment areas inside the pretreatment cell for the cleaning and flame treatment may be separated from one another in terms of ventilation by simple silhouettes.

Cascade flow of the cabin air in this area is possible as well. According to the invention, the provision of an additional pretreatment cell is not provided, which is associated with a significantly reduced amount of required space and a significantly reduced energy consumption as compared to known solutions. By means of the method according to the invention, it is therefore possible for the costs for the pretreatment of polymer surfaces to be painted to be significantly reduced.

Moreover, the transfer of the already-cleaned component to a pretreatment cell provided for flame treatment, which is particularly necessary in the known solutions and during which undesired contamination of the already-cleaned component often occurs due to outside influences, ultimately resulting in a detrimental effect on the quality of the paint job, is omitted in the present invention.

Moreover, due to the direct sequence of the process steps—including cleaning and flame treatment—in one and the same pretreatment cell, it is possible to utilize synergies that lead to an optimal pretreatment result, with disruptive side effects, in particular those caused by transfer, being prevented to the greatest possible extent. Here, an ideal pretreatment result is characterized by a disruption-free use of solvent- or water-based paints on the treated component surface and a surface tension of greater than 40 mN/m, measured, for example, using test paints from the company Arcotest GmbH. In particular, the formation of craters is prevented according to the invention.

BRIEF DESCRIPTION OF THE DRAWINGS

Exemplary embodiments of the invention shall be described in greater detail below with reference to the attached drawings, which show.

DETAILED DESCRIPTION OF THE PREFERRED EMBODIMENT(S)

Figure 1:
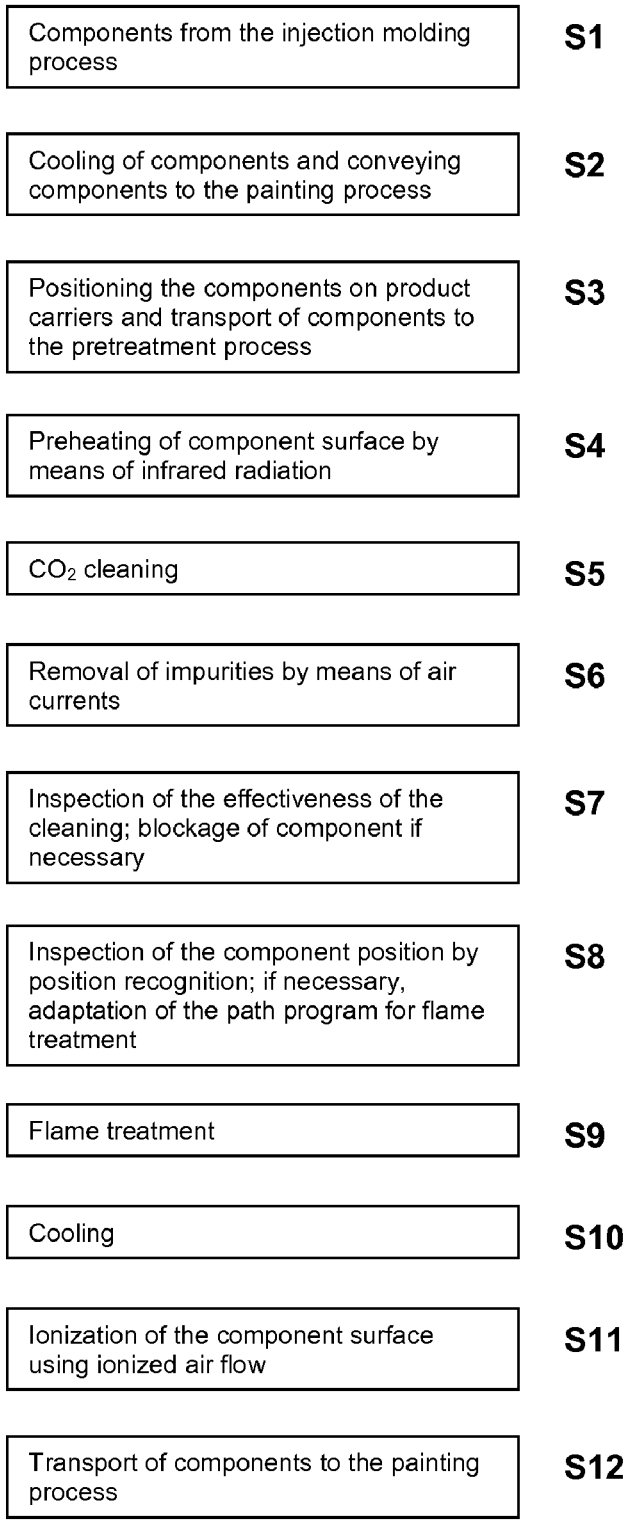
FIG. 1 a schematic process diagram of an exemplary embodiment of the method according to the invention, and FIG. 2 a schematic depiction of an exemplary embodiment of the device according to the invention.

A method and device is provided for the pretreatment of polymer surfaces of components to be painted. At least one polymer surface of at least one component is preheated to a temperature that minimizes condensation on the component when the component is subsequently cleaned inside a pretreatment cell and then treated with an oxidizing flame.

The method and device of the invention has several advantages. In one advantageous refinement of the invention, the component is heated before cleaning, preferably to a temperature in the range of 30° C. to 80° C., with the component being heated by means of irradiation with infrared radiation in one practical refinement of the invention.

As a rule, the components to be painted comprise additives and auxiliary materials that tend to migrate to the surface at elevated temperatures above 30° C., where they usually cause disadvantageous disruptions in paint adhesion.

Because, as a rule, no elevation of temperature occurs during cleaning of the polymer surface, disruptive substances in the form of additives and auxiliary materials may not occur until the flaming process or the treatment of the polymer surface with an oxidizing flame, whereupon they then disrupt the oxidation of the surface during the flame treatment process, which is associated with a negative influence on paint adhesion. In order to provoke this effect before the cleaning of the polymer surface, the component or the surface of the component is heated, preferably by irradiation with infrared radiation, preferably to a temperature in the range of 30° C. to 80° C. so as to prompt seeping out, offgasing, leaking or exuding of the interior additives.

Moreover, the temperature range may preferably be adapted to the type and quantity of the additives and/or be selected as a function of the type and quantity of the additives. The leaked or exuded additives may then be cleaned off of the polymer surface during the cleaning that follows the heating.

Overall, therefore, the heating of the component provided before the cleaning according to the invention is able to significantly improve the effect of the flame treatment, i.e., the effect of the treatment of the polymer surface with an oxidizing flame because no appreciable additional amounts of internal substances or additives from the component will appear on the surface of the component.

In another advantageous refinement of the invention, the polymer surface is cleaned by means of a carbon dioxide cleaning method that, in a practical refinement, is a carbon dioxide snow jet method and, in an additional practical refinement, is a carbon dioxide pellet cleaning method.

Especially by the use of a carbon dioxide jet method, a very effective cleaning of the polymer surface and removal of impurities may be achieved. Carbon dioxide snow ($CO_2$ snow) cleans in a gentle, dry, and residue-free manner and is suitable for a plurality of materials and material combinations. Similar positive characteristics are associated with cleaning using carbon dioxide pellets.

It is true that the $CO_2$ cleaning by means of snow or pellets cools the polymer surface of the component or components, such that moisture from the air condenses on the surface, which in turn disrupts the subsequent flame treatment of the polymer surface. However, the above-described heating of the component performed according to the invention before cleaning, preferably to a temperature in the range of 30° C. to 80° C., means that, after cleaning, only a very small temperature different is provided between the ambient air and the component—which in this case may have a temperature in the range of 10° C. to 50° C., such that a higher humidity in the ambient air of the pretreatment cabin may be accepted without moisture from the air condensing on the component. According to the invention, this significantly reduces the required dehumidification of the supplied air, which is associated with a corresponding savings in energy.

Moreover, the elevated level of moisture, which is therefore acceptable, causes a rapid decomposition of static charges on the surface of the component, which are caused in particular by high-speed jets of air during the $CO_2$ process or $CO_2$ cleaning. According to the invention, disadvantageous contamination may be reduced in this manner.

Moreover, the $CO_2$ cleaning provided according to the invention is able to significantly reduce the temperature of the component after the flame treatment. It is known that flame treatment can cause the temperature of component surfaces to be painted to rise to a level greater than 30° C. For the painting process subsequent to the pretreatment, however, high component temperatures have a disruptive effect because they cause a poor course of the paint (wave). For this reason, it is necessary to provide a surface temperature less than 30° C., which is accomplished in the known solutions by intermediate zones for cooling with ambient air or with supply/exhaust air processes. However, because the $CO_2$ cleaning according to the invention immediately precedes the flame treatment, the flaming or flame treatment of the components is provided at a reduced surface temperature. The temperature level after flame treatment is thus lower than in the known solutions, comprising separate process steps and higher component temperatures existing at the beginning of the flame treatment. Overall, therefore, the expenditure of energy required for cooling before painting or after flame treatment is significantly reduced, which is associated with a significant reduction in operating costs.

In an advantageous refinement of the invention, air is ionized by means of an ionization device for the atomization of carbon dioxide snow or carbon dioxide pellets in order to reduce a static charge of the polymer surface, particularly as a result of high-speed jets of air during the use of $CO_2$ cleaning. The ionization performed according to the invention of the air or process air provided for atomization when using $CO_2$ snow according to the invention can provide an effective discharging of the statically charged polymer component surfaces. In this manner, a subsequent contamination with dust may be significantly reduced according to the invention.

In another advantageous refinement of the invention, after the cleaning of the polymer surface, the polymer surface is tested for residual contaminants in order to determine a degree of impurity and the treatment of the surface with an oxidizing flame is performed only if the resulting degree of impurity lies below a predetermined maximum degree of impurity.

If this maximum degree of impurity is exceeded, an interruption occurs according to the invention of the flame treatment subsequent to the cleaning. The affected components with an excessive degree of impurity are blocked from the painting or application of paint subsequent to the pretreatment. Disruptions to paint adhesion as a result of contaminants can thus be prevented according to the invention.

In a practical refinement of the invention, the impurities removed by the cleaning of the polymer surface are removed by an air current formed in the pretreatment cell. According to the invention, residual impurities before flame treatment on surfaces that have already been cleaned may thus be prevented. Preferably, the air flow is selected here such that the impurities, particularly in the form of removed dust, are transported by the air flow in an essentially downward vertical direction or to a wall and deposited onto filters there. Preferably, the air in the pretreatment cell is moreover configured for supply/exhaust air operation or for air circulation operation. In particular, it is thus possible for circulating dirt, which is increased, for example, by the use of $CO_2$ cleaning, to be prevented according to the invention.

In an advantageous refinement of the invention, it may prove favorable for the pretreatment areas for cleaning and flame treatment within the pretreatment cell to be separated from one another in terms of ventilation by simple silhouettes. The different air flows may thus be separated and deflected in a simple manner; in particular, this allows a specific adaptation and regulation of air sinkage speeds in the cleaning and flame treatment areas.

This may be utilized advantageously for subsequently cooling the polymer surfaces that have been subjected to flame treatment, which may require a different air sinkage speed than cleaning. The air flow in the flame treatment area may also additionally remove loose impurities such as, for example, flying dust.

The invention further relates to a device for the pretreatment of polymer surfaces of components to be painted which is particularly suitable for performing the method according to the invention, having a pretreatment cell inside which at least one cleaning device as well as at least one flame treatment device are disposed, with the cleaning device being provided for cleaning at least one polymer surface of at least one component inside the treatment cell and with the flame treatment device being provided for the treatment of the polymer surface after cleaning with an oxidizing flame inside the treatment cell. By the arrangement of a cleaning device and a flame treatment device inside the same pretreatment cell according to the invention, it is possible to achieve the advantageous effects for the pretreatment of the polymer surface of the component or components described above.

Preferably, the cleaning device is a carbon dioxide snow jet device by means of which the advantageous carbon dioxide snow jet method described above for cleaning the polymer surface of the component may be performed. Moreover, the cleaning device may also be a carbon dioxide pellet cleaning device.

Preferably, the device comprises a heating device for heating the component in order to heat the component before cleaning the polymer surface.

As discussed above, the heating of the component or polymer surface of the component performed by the heating device is able to significantly improve the effect of the treatment of the polymer surface with an oxidizing flame because no additional significant amounts of internal substances or additives from inside the component appear on the surface of the component during and after the flame treatment. Moreover, as discussed above, due to the heating of the component, a very small difference in temperature between the ambient and the component may be provided after cleaning, such that a higher humidity in the ambient air of the pretreatment cabin may be accepted, without the moisture from the air condensing on the surface of the component.

In a concrete refinement of the device according to the invention, the heating device is an infrared irradiation device, which preferably comprises at least one infrared emitter. The use of an infrared radiation technique allows a very practical heating of the components, which is particularly advantageous for the pretreatment and subsequent painting of components in high quantities. The heating intensity may also be adapted to the components by a control unit, whereby an even heating occurs.

In an advantageous refinement of the device according to the invention, at least one positioning device, to which the cleaning device or flaming device is attached and that is designed to dispose the cleaning device or the flaming device in a predetermined position in the area surrounding the polymer surface of the component, is disposed inside the pretreatment cell. In a concrete refinement, the positioning device is a lifting device or a robot, which may preferably be designed as an industrial robot.

By the use of the positioning device according to the invention, which preferably may be designed in the form of a lifting device or a robot or industrial robot, an automatic and/or controlled cleaning and flame treatment of the respective polymer component surface may be performed. According to the invention, the components to be treated should be positioned in such a way that the accessibility of all zones of the component to the cleaning device or cleaning medium and moreover for the flaming device or oxidizing flame is guaranteed.

In a concrete refinement of the device according to the invention, a conveyor device is provided that extends into the pretreatment cell, to which at least one product carrier is attached for transporting the component, with the conveyor device being designed to transport the product carrier in a continuous or synchronized fashion. By means of the conveyor device, which may preferably extend outside of the pretreatment cell into a painting facility, among other places, which is provided for the painting of the components following the pretreatment and subsequent cooling of the components, the device according to the invention may be included in an existing painting process, which is particularly designed for painting components in large numbers. Here, the product carriers predetermine the position and location of the component, which guarantees the accessibility of all zones of the component to the cleaning device or cleaning medium and moreover for the flaming device or oxidizing flame.

In an alternative advantageous refinement, at least one positioning device is disposed inside the pretreatment cell, to which the cleaning device as well as the flaming device are attached, and that is designed for the purpose of disposing the cleaning device and the flaming device in a predetermined position in the area surrounding the polymer surface of the component. This alternative refinement is particularly advantageous in view of reducing the space required and thus the energy consumption, specifically in the case of small provided areas, which load the individual positioning device, preferably in the form of a lift device or robot, at less than 50%; here, one cleaning nozzle of the cleaning device may preferably be installed next to one flaming jet of the flaming device on a robotic arm or on a lift device. Overall, it is thus possible according to the invention for the need for positioning devices to be significantly reduced.

In a concrete refinement of the invention, a control device is provided that is designed to control the positioning device or devices according to a predetermined cleaning path program for cleaning the polymer surface of the component and that is further designed to control the positioning device or devices according to a predetermined flame treatment path program for the treatment of the polymer surface with an oxidizing flame.

The basis for the flame treatment path program and the cleaning path program according to the invention may be a target location and/or target position of the component; the information regarding the target location and/or target position may be provided via an optical detection device for detecting the target state, which may be designed in the form of a camera or a camera system that detects a predetermined target location and/or target position of the component. By means of an image processing device coupled to the optical detection device, the information provided regarding the target location and/or target position of a component may be converted into the data required for providing the flame treatment path program and/or the cleaning path program.

In an additional concrete refinement of the device according to the invention, a device for detecting the position of the component is provided that is designed to detect the position of the component in order to adapt the cleaning path program and/or the flame treatment path program to the detected position, with the device preferably being an optical detection device that may be designed in the form of a camera or a camera system.

The device for position detection of the component is particularly provided according to the invention for detecting the actual location and/or actual position of the component in order to adapt the cleaning path program and/or the flame treatment path program to the detected actual position of the component by comparison with the target location and/or target position described above. By means of an image processing device coupled to the optical detection device, the information provided regarding the actual location and/or actual position of a component may be converted into the data required for providing the flame treatment path program and/or the cleaning path program.

In addition to the detection of the actual location and/or actual position, the device for position detection may be additionally provided for detecting the target conditions, as described above, such that the device for position detection according to the invention may also be used as an optical detection device as described above for detecting the target conditions.

The device according to the invention for position detection is particularly advantageous because $CO_2$ cleaning, particularly the high pressure of the $CO_2$ jets and the process-related pressures, may result in a change in the position of the component, i.e., in particular a deviation from the target position.

When the positioning device according to the invention is used, preferably in the form of robots and lifting devices, this has the effect that partial regions of the component or the surface of the component remain untreated. By using the device for position detection according to the invention, the occurrence of non-treated zones may be prevented by adapting the path programs. In particular, the location and/or position of the component before cleaning, in particular before a $CO_2$ snow jet cleaning, may be detected in order to adapt the cleaning in an optimal fashion to the location and position of the component.

Changes in the position of the component caused by cleaning may also be detected with the device for position detection and the flame treatment path program may be adapted accordingly. In this connection, it was also recognized that the position of the component after the flame treatment of the component is detected with the aid of the position detection device and the location and/or position is transmitted to additional processing stations such as, for example, a painting device.

FIG. 1 shows a schematic process diagram of an exemplary embodiment of the method according to the invention, comprising the steps S1 to S12 in chronological order.

Components produced by means of an injection molding process (S1), for example, automotive bumpers made of PP EPDM whose polymer surface is to be painted with a predetermined vehicle color, are first cooled after the injection molding process to a temperature of 30° C. to 60° C. and subsequently conveyed to a painting process (S2) which, in addition to painting, comprises a pretreatment method according to the invention before painting.

The transport of the components to the pretreatment method is conducted by product carriers attached to a conveyor device, with the components being positioned for this purpose on the product carriers (S3). A subsequent component treatment includes the preheating of the component or the polymer surface of the component by irradiation with infrared radiation (S4). This heating serves to exude inner additives and auxiliary materials. Subsequently, the components are conducted to the $CO_2$ cleaning via the conveyor device inside an enclosed, artificially ventilated, and climate controlled pretreatment cell, where the component surface to be painted is cleaned, preferably using a $CO_2$ snow jet method (S5).

The cleaning is performed using a robot on whose robot arm a $CO_2$ snow jet device is attached, with the movement of the robot arm being controlled in accordance with a predetermined cleaning path program via a control device. Here, all zones of the component to be treated are cleaned in a controlled fashion. In the course of cleaning the component surface, the exuded (cf. S4) additives and auxiliary materials that have wandered to the surface of the component are removed, in particular, those which otherwise could cause disruptions in paint adhesion. The $CO_2$ cleaning occurs using ionized air, which is generated via an ionization device in order to reduce a static charge on the component surface. Via an air flow or air current formed in the pretreatment cell, which is provided using a suitable air guide in conjunction with means generating the air flow (such as, for example, air intake devices), the removed impurities may be removed and preferably deposited onto filters that are provided (S6).

After cleaning, an inspection is conducted of the effectiveness of the cleaning (S7). Only if a maximum predetermined degree of impurity is not exceeded is the pretreatment method continued in the form of a release; otherwise, the affected component is blocked from the subsequent procedures and processes.

After the cleaning is completed, an inspection is conducted of the component position by means of a position detection device in the form of a camera system, which optically detects the position of the component (S8). By means of an image processing device coupled to the camera system, the information provided regarding the actual location and actual position of the component is converted into the data required for the adaptation or correction of a flame treatment path program. Here, a deviation from a predetermined target position may in particular have resulted from the $CO_2$ cleaning and process-related pressures.

Subsequently, the flame treatment of the component surface occurs inside the same pretreatment cell by means of a robot to whose robot arm a flame treatment device has been attached, with the movement of the robot arm being controlled via a control device in accordance with the flame treatment path program, which has optionally been adapted or corrected (S9). Here, all zones of the component to be treated are treated with an oxidizing flame. After the flame treatment has been completed, the components are cooled (S10) and the component surface is subsequently ionized by means of ionized air flow (S11). This is followed by the transport of the components by means of the product carrier to the painting process (S12).

Figure 2:
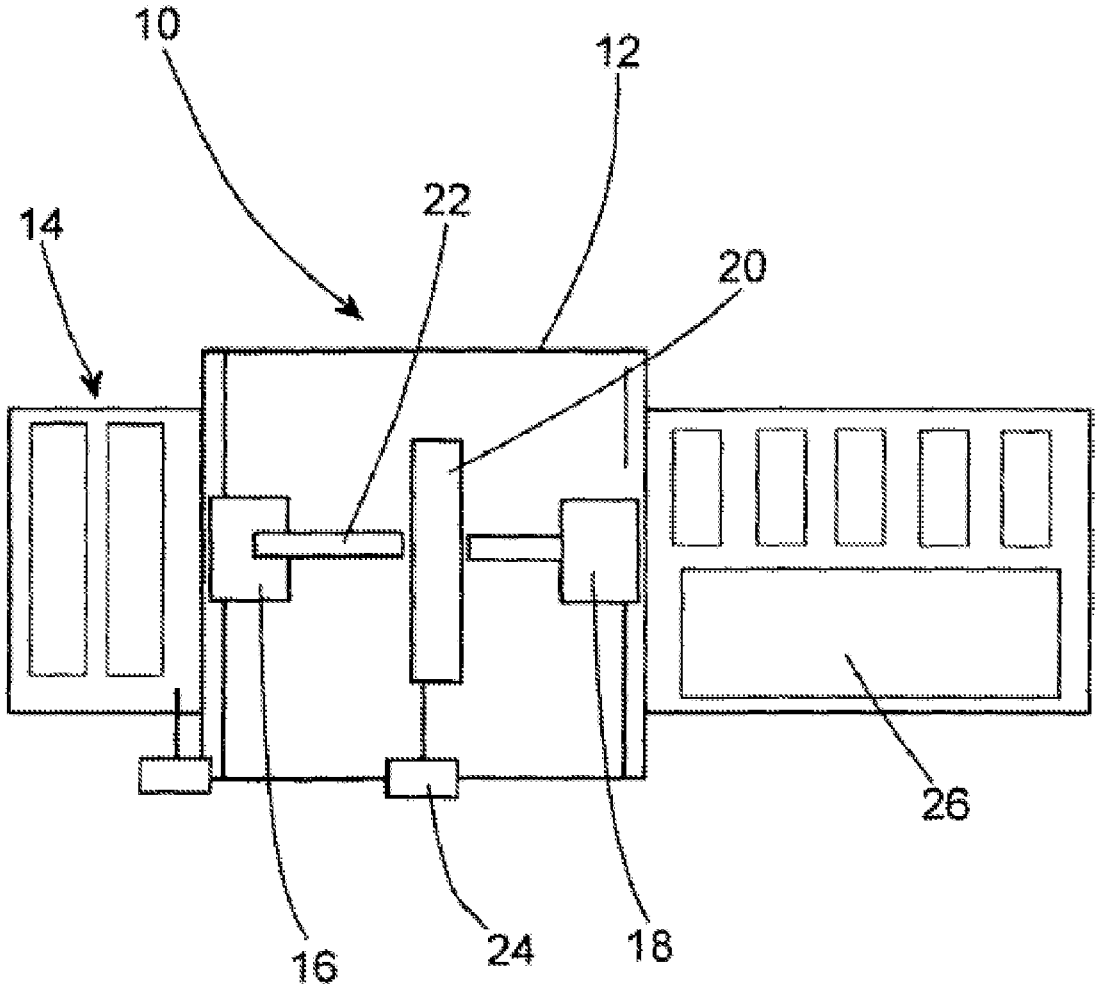

FIG. 2 shows a schematic depiction of an exemplary embodiment of the device 10 according to the invention for the pretreatment of polymer surfaces of components to be painted. The device 10 according to the invention comprises a pretreatment cell in the form of a pretreatment cabin 12 and an infrared irradiation device 14 located outside of the pretreatment cabin 12. A cleaning device 16 in the form of a $CO_2$ snow jet device attached to a robot arm of a first robot (not shown in greater detail) is located inside the pretreatment cabin 12. Moreover, a flame treatment device 18 attached to a robot arm of a second robot (not shown in greater detail) is disposed in the pretreatment cabin 12.

The component 20 to be cleaned and flame treated is first conducted via a product carrier (not shown in greater detail) of a conveyor device 22 to the infrared irradiation device 14 in order to perform the heating of the component according to the invention prior to the cleaning. Subsequently, the component 20 is transported via the product carrier into the pretreatment cabin 12 and to the cleaning device 16 in order to perform the above-described $CO_2$ snow jet cleaning of the surface of the component to be painted. This is followed by the position detection of the component via a position detection device 24, which is designed in the form of a camera system in order to detect any deviations from a predetermined target position, which will be used to adapt the flame treatment path program provided for controlling the robot arm. After the position detection, the component 20 is transported via the product carrier to the flame treatment device 18. After the flame treatment, the component 20 is conducted via the product carrier to the painting process, with FIG. 2 furthermore schematically showing an evaporation zone 26 of a painting system in which the surface of the component is painted.

The invention claimed is:

1. A method for the pretreatment of polymer surfaces of components to be painted, the method including the steps of:

preheating at least one component to a temperature that minimizes condensation on the component when the component is subsequently cleaned inside a pretreatment cell;

cleaning at least one polymer surface inside the pretreatment cell; and treating the at least one component polymer surface with an oxidizing flame, wherein the cleaning of the polymer surface as well as the treatment of the polymer surface with an oxidizing flame are performed inside the same pretreatment cell.

2. The method according to claim 1, wherein impurities removed from the polymer surface by the cleaning are removed by an air flow formed in the pretreatment cell.

3. The method according to claim 1, wherein the polymer surface is cleaned-by means of a carbon dioxide cleaning method.

4. The method according to claim 1, wherein, after cleaning of the polymer surface, the polymer surface is inspected for residual impurities in order to determine a degree of impurity and the treatment of the surface with an oxidizing flame is performed only if the degree of impurity detected falls below a predetermined maximum degree of impurity.

5. The method according to claim 1, wherein impurities removed from the polymer surface by the cleaning are removed by an air flow formed in the pretreatment cell.

6. The method according to claim 2, wherein, after cleaning of the polymer surface, the polymer surface is inspected for residual impurities in order to determine a degree of impurity and the treatment of the surface with an oxidizing flame is performed only if the degree of impurity detected falls below a predetermined maximum degree of impurity.

7. The method according to claim 3, wherein the carbon dioxide cleaning method is a carbon dioxide snow jet method or a carbon dioxide pellet cleaning method.

* * * * *

UNITED STATES PATENT AND TRADEMARK OFFICE

CERTIFICATE OF CORRECTION

PATENT NO. : 8,398,780 B2
APPLICATION NO. : 12/663865
DATED : March 19, 2013
INVENTOR(S) : Peter Krauss et al.

It is certified that error appears in the above-identified patent and that said Letters Patent is hereby corrected as shown below:

In the Specifications:

In Col. 2, line 65, replace the phrase "ture in the range of30°C." with --ture in the range of 30°C.--

In Col. 3, line 50, replace the phrase "ture different is provided" with --ture difference is provided--

In the Claims:

In Col. 10, line 13, replace the phrase "5. The method according to claim 1," with --5. The method according to claim 4,--

Signed and Sealed this
Twenty-eighth Day of May, 2013

Teresa Stanek Rea
*Acting Director of the United States Patent and Trademark Office*